US005872076A

United States Patent [19]

Kobayashi et al.

[11] Patent Number: 5,872,076

[45] Date of Patent: Feb. 16, 1999

[54] METHOD FOR REUSING IMAGE RECORDING MATERIALS AND APPARATUS THEREFOR

[75] Inventors: Tomoo Kobayashi; Kaoru Torikoshi, both of Minami-ashigara; Tadakazu Edure, Ashigarakami-gun, all of Japan

[73] Assignee: Fuji Xerox Co., Ltd., Tokyo, Japan

[21] Appl. No.: 766,342

[22] Filed: Dec. 16, 1996

[30] Foreign Application Priority Data

Dec. 21, 1995 [JP] Japan ..... 7-333373

[51] Int. Cl.[6] ..... B41M 5/30; B41M 7/00

[52] U.S. Cl. ..... 156/234; 156/235; 427/121; 427/140; 427/141; 428/195; 428/327; 428/328; 428/329; 428/331; 428/447; 428/480; 428/913; 428/914; 430/33

[58] Field of Search ..... 15/77; 156/230, 156/234, 235; 427/121, 140, 141; 428/195, 327–329, 331, 447, 480, 484, 488.4, 913, 914; 430/33

[56] References Cited

FOREIGN PATENT DOCUMENTS

| | | | |
|---|---|---|---|
| A-1-101576 | 4/1989 | Japan | 156/234 |
| A-1-101577 | 4/1989 | Japan | 156/234 |
| A-1-297294 | 11/1989 | Japan | 156/234 |
| A-4-349486 | 12/1992 | Japan | 156/234 |
| A-6-208318 | 7/1994 | Japan | 156/234 |
| A-6-250569 | 9/1994 | Japan | 156/234 |
| A-6-250570 | 9/1994 | Japan | 156/234 |
| A-6-266264 | 9/1994 | Japan | 156/234 |
| A-6-273966 | 9/1994 | Japan | 156/234 |
| A-6-289643 | 10/1994 | Japan | 156/234 |
| A-7-13383 | 1/1995 | Japan | 156/234 |

*Primary Examiner*—Bruce H. Hess
*Attorney, Agent, or Firm*—Oliff & Berridge, PLC

[57] ABSTRACT

The present invention relates to a method and apparatus for reusing an image recording material wherein a releasing property is imparted to at least substrate surface of an image recording material on which an image has been formed of an image forming material containing a heat fusible ingredient, a heat fusible material is added or attached onto the image recording material, a stripping member is contacted under pressure with the heat fusible material while heating the heat fusible material together with the image recording materials to fuse, and the image recording material is peeled off from the stripping member to transfer the image forming material together with the heat fusible material to the stripping member, thereby reusing the image recording material. The materials for imparting a releasing property to the substrate surface include silicone compounds such as silane compounds, preferably those silane compounds containing fine particles such as silicone resins. The heat fusible material preferably comprises the same ingredient as the heat fusible ingredient in the image forming material. Base materials of the image recording materials, such as paper, can be efficiently be reused.

10 Claims, 5 Drawing Sheets

METHOD FOR REUSING IMAGE RECORDING MATERIALS AND APPARATUS THEREFOR

BACKGROUND OF THE INVENTION

Field of the Invention

The present invention relates to a method for reusing an image recording material used in electrophotographic recording or thermal transfer recording and a reusing apparatus therefor. More particularly, it relates to a method for reusing a reusable image recording material wherein image formation with an image forming material and removal thereof can be repeated by removing an image forming material from an image recording material on which the image forming material has been retained, and a reusing apparatus for reusing an image recording material.

DESCRIPTION OF RELATED ART

Recently, global environmental destruction has come to light and the importance of forest resource conservation has been recognized; consequently, it has become an important subject to reduce the amount of wood resources utilized as raw materials of paper. In one of means for the reduction at present, waste paper is not discarded as refuse and recycling thereof has been developed. Although the reuse of waste paper is an important means for recovering resources, there may be many problems in the preparation of reused paper. For example, recovery of waste paper has the following problems: leakage of confidential documents or data, particularly in enterprises; operation such as recovery of paper sorted with kinds of paper, and transportation thereof; and accumulating places for and control of recovered waste paper.

Further, reuse of waste paper may lead to deterioration in quality of reused paper since pulp fibers may be shortened during repulping of the waste paper. Further, a device for deinking from image areas is required. A paper machine itself is large, complex and expensive and, therefore, reuse of paper can not be done by an individual but can be effected only by a certain enterprises. Unless the sorted recovery, transportation, accumulation and operation of a large device are performed efficiently, a large amount of energy will be consumed, i.e., the amount of $C0_2$ discharged will be large. Consequently, the global warming phenomenon associated with the increase of the amount of $C0_2$, which is one of global environmental problems, may further be accelerated.

As a solution for these problems, a method has been disclosed for erasing an image on a recording material, such as paper, once used to regenerate the material. The methods and apparatuses for removing an image on paper by a physical means include those disclosed in the following patent publications.

JP-A No. 1-101576 and JP-A No. 1-101577 disclose a method for reusing paper comprising immersing a sheet of paper or film on which an image forming toner has been deposited in an organic solvent in which the toner resin can be dissolved, and applying ultrasonic vibration thereto to release the toner dissolved in the solvent from the paper surface. In this method, however, the dissolved toner may penetrate again into the paper and stain the paper. Further, there are many other problems: undesired noise produced by the vibration; contamination in room due to the use of organic solvents; inflammability; and toxicity. This method is difficult to employ generally in homes and offices.

JP-A No. 4-349486 discloses that an image area or the entire surface of paper, on which the images have been recorded, is coated with an image forming material having the same color as the paper (e.g., white color toner). In this method, unlike peeling off an image portion from paper, the paper surface becomes glossy and the thickness of the paper is increased by repeating reuse. Consequently, the paper seems to be a special paper after reuse.

JP-A No. 6-208318, JP-A No. 6-250569, JP-A No. 6-250570, JP-A No. 6-266264, JP-A No. 6-273966, JP-A No. 6-289643 and JP-A No. 7-13383 disclose that a recording material such as paper on which an image is recorded is impregnated by dipping or spraying with a deinking agent (e.g., surfactant) solution, or that a solution of a water soluble polymer and a surfactant is coated on the surface or back surface of a recording material to penetrate into the recording material and the image forming material on the recording material is brought into contact with an image remover and heated to adhere with each other, and the image portion is peeled off from the recording material.

However, these methods also have many problems: organic solvents should be used; even if an aqueous solution is used, recording materials including paper is corrugated or wrinkled during being dried. Paper may become transparent due to the surfactants or polymers which are not evaporated but accumulated during repeated use. In solid image where an image is formed on the whole surface of a recording material unlike a character image, the surfactant may hardly penetrate through the image forming material to reach the surface of the recording material. Therefore, the releasability of the image forming material from the paper as a recording material can not be enhanced. Consequently, the surface of the recording paper may be damaged upon peeling off since fibers of the surface of the paper may also be peeled off together with the image forming material. When a surfactant is penetrated from the back surface of a recording material, this method is difficult to apply to double-side copied paper. Further, the apparatus can not be made compact since some space must be provided to contain and retain the solvent. Even if an aqueous solution is substituted for the organic solvent from the viewpoint of safety, maintenance cost for supplementing and purchasing the aqueous solution are required. A large amount of heat is required to evaporate and dry the moisture from a recording material paper. As a result, a large amount of energy consumption poses a high running cost.

JP-A 1-297294 discloses a cleaning method wherein a support comprising plastic, metal, liquid-impermeable paper or ceramic bearing an image thereon is used, and an image formed from a heat fusible ink on the support is removed from the support by heating an ink stripper through a heat fusible stripper. Thereafter, the ink stripper is cooled and the image is peeled off from the support. The support used in this method is a film or special paper which is quite different from usual paper in touch and feeling and is more expensive than the usual paper. The reason why any liquid-permeable paper can not be used as a support is that when the heat fusible ink is fused, the paper fibers are impregnated with the fused ink, the portion of which can not be stripped off. This method is time-consuming since cooling to room temperature is required before peeling off the image from the support. Further, since the heat fusible stripper and ink stripper are different from each other in their thermal expansion coefficients, they may separate from each other during cooling and some space is produced therebetween where the heat fusible ink can not be stripped off from the support.

Even if this problem may be solved by enhancing the adhesion strength between the heat fusible stripper and the ink stripper, the adhesion strength with the support is also enhanced and the support may be deformed and the force required to peel off will be extremely large. As a result, a drawback that this portion of the apparatus becomes large arises. Further, since an OHP film as an image bearing support generally used has an image receiving layer to enhance the fixing of an image forming material, it will be also difficult to peel off the OHP film from the ink stripper by the cooling and peeling method.

SUMMARY OF THE INVENTION

The present invention has been made to solve the above described drawbacks in view of the above described prior art.

Therefore, it is an object of the present invention to provide a reusing method and apparatus using an image recording material which can be reused by an individual by himself without entrusting a specialist with the reuse of the recording material. Another object of the present invention is to provide a reusing method and apparatus using an image recording material to which releasability is imparted such that image forming materials can be removed while retaining good fixation of the image forming materials onto the image recording material without damaging the recording surface.

A still another object of the present invention is to provide a reusing method and apparatus permitting reuse of an image recording material even when not only a monochromatic but also color image is printed in a solid manner, i.e., on the whole surface of a recording material, by an electrophotographic or thermal transfer image forming method.

A further object of the present invention is to provide a reusing method and apparatus which maintain safe environment in homes and offices in the absence of any organic solvent and further do not use any aqueous solution to prevent consumption of a large amount of energy for drying. A still further object of the present invention is to provide an apparatus permitting the combined use of an image forming device and an image removing device resulting in effective utilization of spaces in an office.

The present inventors have extensively studied methods and apparatus for reusing image recording materials. As a result, the present invention comprises adding or attaching a heat fusible material onto an image recording material having releasability at least on the surface of a substrate on which an image is formed from an image forming material comprising a heat fusible material, pressing a stripping member thereon while heating and fusing the heat fusible material and the image forming material, and separating the image recording material from the stripping member to transfer the image forming material to the stripping member together with the heat fusible material, whereby the image recording material is reused.

Preferably, a main ingredient of the heat fusible material added or attached to the image recording material is the same as the main ingredient of the heat fusible material contained in the image forming material. It is preferred that the heat fusible material contains fine particles, that the heat fusible material is powder, that the powdery material can retain a certain amount of electric charge, that the powdery material is a toner, and that the powdery material becomes colorless and transparent or white after being molten.

Further, the addition or attachment of the powder to the image recording material may preferably be performed in an electrophotographic method. Also, it is preferable that the apparatus is equipped with an image reader for identifying an image read-out data region on an image recording paper and means for setting a region to which a heat fusible material is to be added or attached in accordance with the region from which the image is to be removed. According to this feature, the heat fusible material used for the removal of the image portion is not consumed in amounts more than required, or the amount of the heat fusible material corresponds to a part of the image area to be erased. Further, the reusing apparatus for image recording materials can serve as both an image forming device and as an image removing device and therefore the space of an office can be effectively utilized.

DESCRIPTION OF THE PREFERRED EMBODIMENTS

Figure 1:
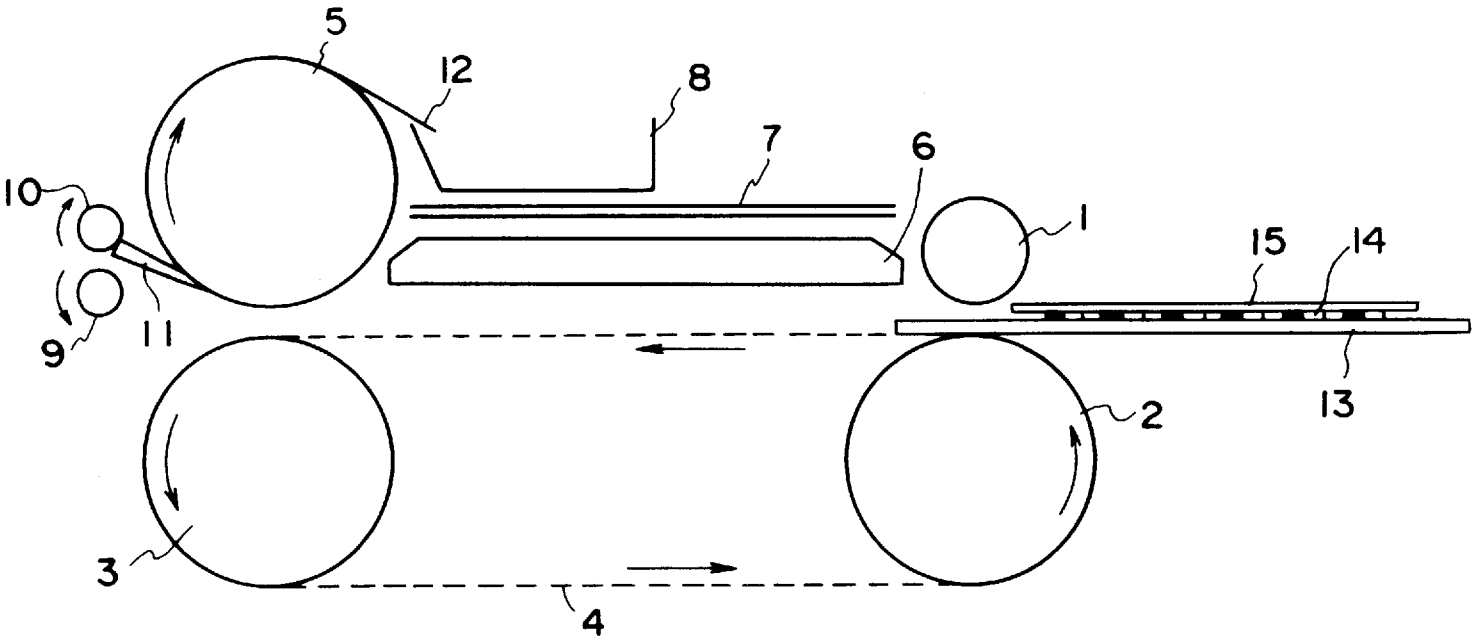
FIG. 1 is a schematic drawing showing one embodiment of the method for reusing an image recording material according to the present invention.

The method for reusing an image recording material according to the present invention will be hereinbelow described in more detail.

The image recording material used in the present invention has at least the surface of the substrate thereof which is releasable with respect to image forming. Materials of the substrate of the image recording materials include paper, metals, plastics and ceramics, preferably in the form of a film.

When paper is used as a base material in the present invention, the image recording material is paper whose surface has releasability. The pulp for use in the paper as a base material may preferably be virgin bleached chemical pulp prepared by chemically treating wood and other fibrous materials such as, hardwood bleached and unbleached craft pulp, hardwood bleached sulfite pulp, soft wood bleached and unbleached craft pulp, soft wood bleached sulfite pulp and soda pulp, followed by bleaching step; among them, those having a higher whiteness are more preferable. Further, waste pulp may be preferably, for example, waste pulp prepared by dissociation of unprinted topmost, special, medium white and unprinted white waste papers which are cut waste, spoilage and end-cut produced in bookbinding, printing and cutting factories; or waste pulp prepared by dissociation of waste paper such as woodfree paper, woodfree coated paper, medium quality paper, medium quality coated paper, or groundwood paper printed by planographic, letterpress or intaglio printings, or electrophotographic, thermal-sensitive, thermal transfer, pressure sensitive recording papers, ink jet recording paper or carbon paper, waste paper recorded with aqueous or oil based ink or pencils, or waste newspaper, followed by deinking in most appropriate manners for respective waste papers. Pulp from planographically printed waste paper which is relatively easy to deink is preferred; in particular, waste paper pulp with a higher whiteness and smaller amounts of contaminants is more preferable.

In the image recording material used in the present invention, releasability is imparted to the surface of a substrate by coating or impregnating a material having good releasability with respect to an image forming material on the surface of pulp fibers of an image recording paper prepared from the above mentioned pulp or on the surface of a coating material of a coated paper. Many of these materials to be coated or impregnated tend to decrease the specific surface area of paper and to deteriorate fixing characteristics of the image forming materials onto the recording paper. If the surface of the paper has moderate unevenness or roughness, however, the paper has sufficient fixing characteristics. In order to satisfy both fixing characteristics and releasability of image forming materials, an appropriate unevenness of the surface of the paper is necessary. Accordingly, it is preferable that the materials to be coated on or impregnated preferably penetrate into the pulp fibers and the unevenness of the surface of the paper is not changed.

Illustratively, materials having good releasability include fluorine materials, fluorine oils, silicone materials and silicone oils. Materials which directly react to bind to the pulp fibers are more preferable from the above mentioned viewpoint and in view of migration from the substrate surface to others and runnability of paper. The materials chemically reacting directly with pulp fibers to bind thereto to provide the substrate surface having good releasability relative to image forming materials desirably comprise silicone compounds or silicone compounds and fine particles.

The silicone compounds comprise compounds which can bind to the substrate mainly composed of pulp fibers and the fine particles by chemical reaction. Preferred silicone compounds include fluorine-containing silicone compounds, isocyanatosilane compounds, modified silicone oils having a reactive group in the molecule. These compounds may be used as a mixture. The material forms a coating layer having releasability by coating on or impregnating into a recording paper and drying. These silicone compounds also have high reactivity with fine particles such as talc, clay (kaoline), calcium carbonate, titanium oxide, aluminum oxide, aluminum sulfate, zirconium oxide, barium titanate, silica, silicone resin, acryl resin, styrene resin, styrene-acryl resin, melamine resin, benzoguanamine resin and melamine-bonzoguanamine resin. These silicone compounds harden together with pulp fibers and serve to fix the fine particles in the paper.

The silicone compounds include silane compounds such as chlorosilanes, e.g., $CH_3SiCl_3$, $(CH_3)HSiCl_2$, $(CH_3)_2SiCl_2$, $(CH_3)_3SiCl$, $C_6H_5SiCl_3$ and $(C_6H_5)_2SiCl_2$; alkoxysilanes, e.g., $Si(OCH_3)_4$, $CH_3Si(OCH_3)_3$, $(CH_3)_2Si(OCH_3)_2$, $C_6H_5Si(OCH_3)_3$, $Si(OC_2H_5)_4$, $CH_3Si(OC_2H_5)_3$, $(CH_3)_2Si(OC_2H_5)_2$, $C6H_5Si(OC_2H_5)_3$ and $(CH_3)_2CHCH_2Si(OCH_3)_3$; silazanes, e.g., $(CH_3)_3SiNHSi(CH_3)_3$; and silylating agents, e.g., $(CH_3)(SiNH)_2CO$ and tert-$Bu(CH_3)_2SiCl$; and silane coupling agents such as vinylsilanes, e.g., vinyltrichlorosilane, vinyltris(β-methoxyethoxy)silane, vinyltriethoxysilane and vinyltrimethoxysilane; acrylsilanes, e.g., γ-methacryloxypropyltrimethoxysilane; epoxysilanes, e.g., β-(3,4-epoxycyclohexyl) ethyltrimethoxysilane, γ-glycidoxypropyltrimethoxysilane, and γ-glycidoxypropylmethyldiethoxysilane; and aminosilanes, e.g., N-β(aminoethyl)-γ-aminopropyltrimethoxysilane, N-β(aminoethyl)-γ-aminopropylmethyldimethoxysilane, γ-aminopropyltriethoxysilane, N-phenyl-γ-aminopropyltrimethoxysilane. Other silane compounds such as $HSC_3H_6Si(OCH_3)_3$ and $ClC_3H_6Si(OCH_3)_3$as well as hydrolysates or partial condensates of these silane compounds may also be exemplified.

The isocyanatosilane compounds may include $(CH_3)_3SiNCO$, $(CH_3)_2Si(NCO)_2$, $CH_3Si(NCO)_3$, vinylsilyltriisocyanate, $C_6H_5Si(NCO)_3$, $Si(NCO)_4$, $C_2H_5OSi(NCO)_3$, $C_8H_{17}Si(NCO)_3$, $C_{18}H_{37}Si(NCO)_3$, and $(NCO)_3C_2H_4Si(NCO)_3$.

The reactive silicone oils having a reactive group introduced into the molecule include amino-, epoxy-, carboxyl-, carbinol-, methacryl-, mercapto- and phenol-modified ones.

The fluorine-containing silicone compounds preferably comprise a perfluoroalkyl group in order to further improve the releasability. These compounds may include, for example, $C_6F_{13}C_2H_4SiCl_3$, $C_6F_{13}C_2H_4Si(OCH_3)_3$, $C_7F_{15}CONH(CH_2)_3Si(OC_2H_5)_3$, $C_8F_{17}C_2H_4SiCl_3$, $C_8F_{17}C_2H_4Si(OCH_3)_3$, $C_8F_{17}C_2H_4SiCH_3Cl_2$, $C_8F_{17}C_2H_4SiCH_3(OCH_3)_2$, $C_8F_{17}C_2H_4Si(ON{=}C(CH_3)(C_2H_5)_3$, $C_9F_{19}C_2H_4Si(OCH_3)_3$, $C_9F_{19}C_2H_4Si(NCO)_3$, $(NCO)_3SiC_2H_4C_6F_{12}C_2H_4Si(NCO)_3$, $C_9F_{19}C_2H_4Si(C_2H_5)(OCH_3)_2$, $(CH_3O)_3SiC_2H_4C_8F_{16}C_2H_4Si(OCH_3)_3$, and $(CH_3O)_2(CH_3)SiC_9F_{18}C_2H_4Si(CH_3)(CH_3O)_2$, as well as hydrolysates and partial condensates of these compounds.

Silica gel may be used in addition to the above described silicone compounds. These silicone compounds may be used alone, but, mixtures of two or more compounds or their partial hydrolysates may preferably be used.

In addition to the above mentioned ingredients, liquid compositions for forming the substrate surface having good releasability may contain an aluminum compound, a titanium compound, a zirconium compound, a fluorine compound, or the like, in amounts that do not impair the effects, for example, aluminum isopylate, aluminum sec-butyrate, aluminum tert-butyrate, tetra-iso-propyl titanate, tetra-n-butyl titanate, tetra-iso-butyl titanate, tetra-sec-butyl titanate, tetra-tert-butyl titanate, tetra-n-pentyl titanate, tetra-iso-pentyl titanate, tetra-n-hexyl titanate, tetra-n-heptyl titanate, tetra-n-octyl titanate, tetra-iso-octyl titanate, tetra-n-nonyl titantate, tetramethyl zirconate, tetraethyl zirconate, tetra-iso-propyl zirconate, tetra-n-propyl zirconate, tetra-n-butyl zirconate, tetra-iso-butyl zirconate, tetra-tert-butyl zirconate, mono-sec-butoxyaluminum diisopropylate, ethylacetoacetatoaluminum diisopropylate, di-n-butoxyaluminum monoethylacetoacetate, aluminum di-n-butoxide methyl acetoacetate, aluminum diisobutoxide monomethyl acetoacetate, aluminum di-sec-butoxide monoethyl acetoacetate, aluminum di-iso-propoxide monoethyl acetoacetate, aluminum trisacetylacetonate, aluminum di-iso-propoxide monoacetylacetonate, aluminum monoacetylacetonate bis(ethylacetoacetate), aluminum tris (ethylacetoacetate), cyclic aluminum oxide acylate compounds, di-iso-propoxytitanium bis(acetylacetonate), di-n-butoxytitanium bis(acetylacetonate), tetraoctylene glycol titanate, and tetrakisacetylacetone zirconate.

The fluorine compounds may include fluoroolefin resins, such as tetrafluoroethylene, chlorotrifluoroethylene, hexafluoropropylene and perfluoropropylvinylether. These may be used as a mixture of two or more compounds. Further, copolymers may preferably be used into which a vinyl ether, such as ethyl vinyl ether or cyclohexyl vinyl ether and a hardening agent are introduced. Also, included are perfluoropolyethers represented by $X\text{-}CF_2(OC_2F_4)_p(OCH_2)_qOCF_2\text{-}X$; illustratively, isocyanato-modified ones wherein X represents $OCN\text{-}C_6H_3(CH_3)NHCO\text{-}$, carboxyl group-modified ones wherein X represents -COOH, alcohol-modified ones wherein X represents $-CH_2OH$ or $-CF_2\text{-}CH_2((OCH_2CH_2)_n)OH$ and ester-modified ones wherein X represents -COOR.

The fixing and releasing properties of image recording paper depend on the surface state of a substrate and the selection of silicone compounds as well as the thickness of a coating with respect to the substrate, the amount of fine particles with respect to the silicone compounds, and the mean particle diameter of the fine particles and the like. The thickness of a coating is preferably 0.05 to 5.0 μm excluding the fine particles. With a coating of less than 0.05 μm in thickness, it is difficult to fix the fine particles to a substrate and may deposit from the substrate. When the thickness of the coating is larger than 5.0 μm , the substrate becomes glossy due to smoothing even if larger particles are added and substrate becomes different feeling from plain paper.

The content of the fine particles in the silicone compound may depend upon the nature of silicone compound and fine particles and is desirably 1 to 100 parts by weight based on 100 parts by weight of the silicone compound. The fine particles blended in an amount of less than 1 part by weight in the silicone compound is insufficient to fill partial holes in the paper. An amount of more than 100 parts by weight of the fine particles makes it difficult to fix the particles on a substrate. The mean particle diameter of the fine particles is desirably 0.1 to 15 μm , particularly preferably 0.3 to 5.0 μm. When the fine particles have a mean particle diameter more than 15 μm , touch of paper is obviously changed and images may be affected. If the mean particle diameter of the fine particles is less than 0.1 μm, the finely divided particles aggregate so that the dispersibility of a coating solution may be deteriorated, and because of increased specific surface area, the reactive sites on the surface of the particles are increased so that chemical reaction of the silicone compound are only applied to the fine particles and the chemical reaction of the silicone compound with a substrate does not take place resulting in difficulty of fixation.

The methods for coating or impregnating these materials to form a coating may be conventional and include blade coating, wire bar coating, spray coating, dip coating, bead coating, air knife coating, curtain coating and roller coating.

The drying for forming the substrate surface may be air-drying; heat-drying may further enhance the releasability to image forming materials. The reason therefor is uncertain, but is believed that the ingredients which have reacted with pulp fibers may be arranged or oriented. The surface-treated substrate may be dried in any conventional manner, for example, by placing in or passing through an oven or contacting with a heated roller.

As one example of the methods for removing images from a recording paper on which the images have been formed comprising employing an image recording paper having releasability for image forming materials, treatment of images obtained by electrophotographic method will be illustrated below.

Image formation on paper through electrophotography comprises the steps of electrostatically uniformly charging the surface of an electrophotographic photoreceptor, exposing image information obtained onto the surface, and forming an electrostatic latent image corresponding to the exposure. Then the electrostatic latent image is visually developed by supplying a toner from a developing unit onto the electrostatic latent image on the electrophotographic photoreceptor surface, and the developed image is transferred to a recording material such as paper. Finally, the toner is fixed on the recording material by applying heat or pressure thereto to produce an image recorded paper.

Thus, an important point in the reuse of recording paper is fixation. It can be readily understood that when fixed with heat, the toner may be fused by reheating and easily peeled off from the paper. As far as plain paper is concerned, however, only heat treatment will leave such an amount of toner on the paper that one can recognize clearly a letter or image thereon. The toner contains a material for improving the fixation which has a good affinity with the paper fibers. On the other hand, adequate unevenness on the paper surface provides sufficient fixation only by adhering the toner to fibers or by adhering the toner to the fibers by enclosing the fibers with the toner. For these reasons, the paper is treated with the aforementioned materials.

Even if paper having improved releasability relative to toners is used, stripping of toner images with merely heating is still insufficient. There are spaces partially in the form of relatively large holes in paper comprising fibers superimposed, and the toner which has penetrated into such relatively deep spaces can not be pulled out. One means for pulling out the toner is to further insert material to be packed into the spaces to pull out the toner. Such a material to be inserted is preferably a heat fusible material having a good affinity with the toner and thermal properties similar to those of the toner. For these reasons, the main ingredient material in the toner is particularly preferred as the heat fusible material. Though not fully understood, fine particles in the heat fusible material would further enhance the effects of the heat fusible material on the stripping of image forming materials. Such fine particles may include titanium oxide, aluminum oxide, zirconium oxide, barium titanate, silica, silicone resin, acryl resin, styrene-acryl resin, melamine resin, benzoguanamine resin and melamine-benzoguanamine resin. Fine particles of silicone resins are suitable.

The heat fusible material is added or attached onto the image (toner). The easiest method therefore is an electrophotographic method, as long as the heat fusible material is similar to the toner. The image forming material such as toner or the like and the heat fusible material are heated to fuse, and pressurized together with a stripping member. Thereafter, the stripping member is separated from a paper, thereby removing the toner and heat fusible material form the paper. Where a toner which has penetrated into spaces in a deep place is withdrawn therefrom, it is believed that the repulsion force on the toner due to release-treatment and/or the pushing effect by reduced pressure generated by release of the pressure may be acted for the removal of the image forming material.

As stated above, the method for removing an image forming material from a recording paper on which an image has been formed using an image recording paper whose releasability is improved with respect to the image forming material is not limited to the electrophotographic method, but in principle, the use of an electrophotographic apparatus is most effective as described above. As mentioned above, only the final step in the electrophotographic process has different functions, i.e., fixation and stripping of the image. Accordingly, the image recording apparatus can be the image erasing apparatus at the same time, and therefore, both image forming and erasing can be effected in a single machine.

Figure 2:
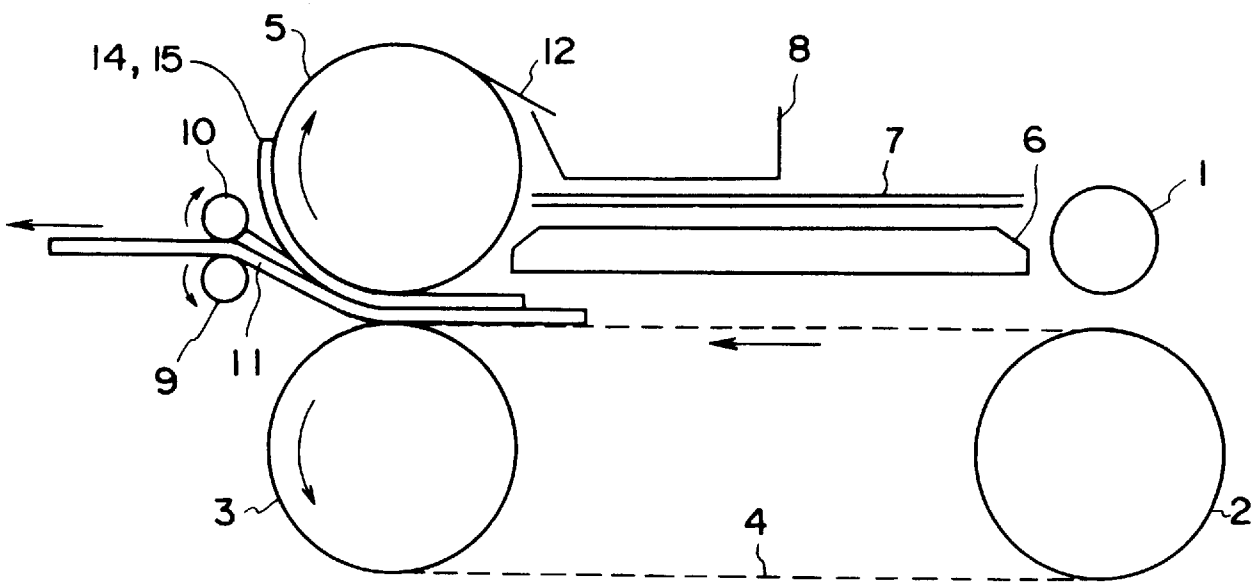
FIG. 2 is a schematic drawing showing another embodiment of the method for the reusing a recording material according to the present invention.

FIG. 1 is a schematic drawing showing an example of an apparatus for reusing an image recording material for the purpose of performing a method for reusing the image recording material according to the present invention. FIG. 2 is a schematic drawing showing an embodiment for operating the apparatus. As seen in FIG. 1, a pair of transporting rollers 1, 2 are disposed and a transporting belt 4 is entrained between the transporting roller 2 and a pressure roller 3. A stripping roller 5 which has been anodized to from an anodized aluminum (alumite) is spaced at a predetermined distance from the pressure roller 3 above the pressure roller 3. A heater 6 is arranged between the transporting roller 1 and the stripping roller 5 and above the transporting belt 4. A box 8 for collecting stripped matters is arranged above the heater 6 through an insulator 7.

Close to the lower end of the stripping roller 5, a pair of transporting rollers 9, 10 having a smaller diameters are arranged. A strip finger 11 is disposed between the transporting roller 10 and the stripping roller 5 such that the tip end of the finger 11 is in contact with the peripheral surface of the stripping roller 5. Further, a cleaning blade 12 is provided on the upper side of the stripping roller 5.

An image of a toner 14 is formed on a recording paper 13, the surface of which has releasability and a film-like heat fusible material 15 is placed on the image formed surface. As shown in FIG. 2, the recording paper 13 on which an image has been formed and the heat fusible material 15 are then passed through a pair of transporting rollers 1, 2 and transported by the transporting belt 4. The heater 6 has been pre-heated at about 100° C. and the recording paper 13 on which an image has been formed and the heat fusible material 15 are heated from the upper side such that the heat fusible material 15 and the toner 14 on the recording paper 13 are fused. The recording paper 13 in this state reaches between the pressure roller 3 and the stripping roller 5 and is pressed thereby.

The toner 14 and heat fusible material 15 in the fused state are adhered to the stripping roller 5 and separated from the recording paper 13 by the strip finger 11. As the stripping roller 5 rotates, the fused toner 14 and heat fusible material 15 are gradually cooled and stripped from the stripping roller 5 by the cleaning blade 12. The recording paper 13 is thus regenerated and taken out through the pair of transporting rollers 9, 10. The stripped toner 14 and heat fusible material 15 are recovered in the box 8 for collecting stripped matters. Since the insulator 7 is disposed between the box 8 for collecting stripped matters and the heater 6, the toner 14 and the heat fusible material 15 are not sticked to the box 8 for collecting stripped matters and can easily be taken out and may be discarded, if necessary.

Figure 3:
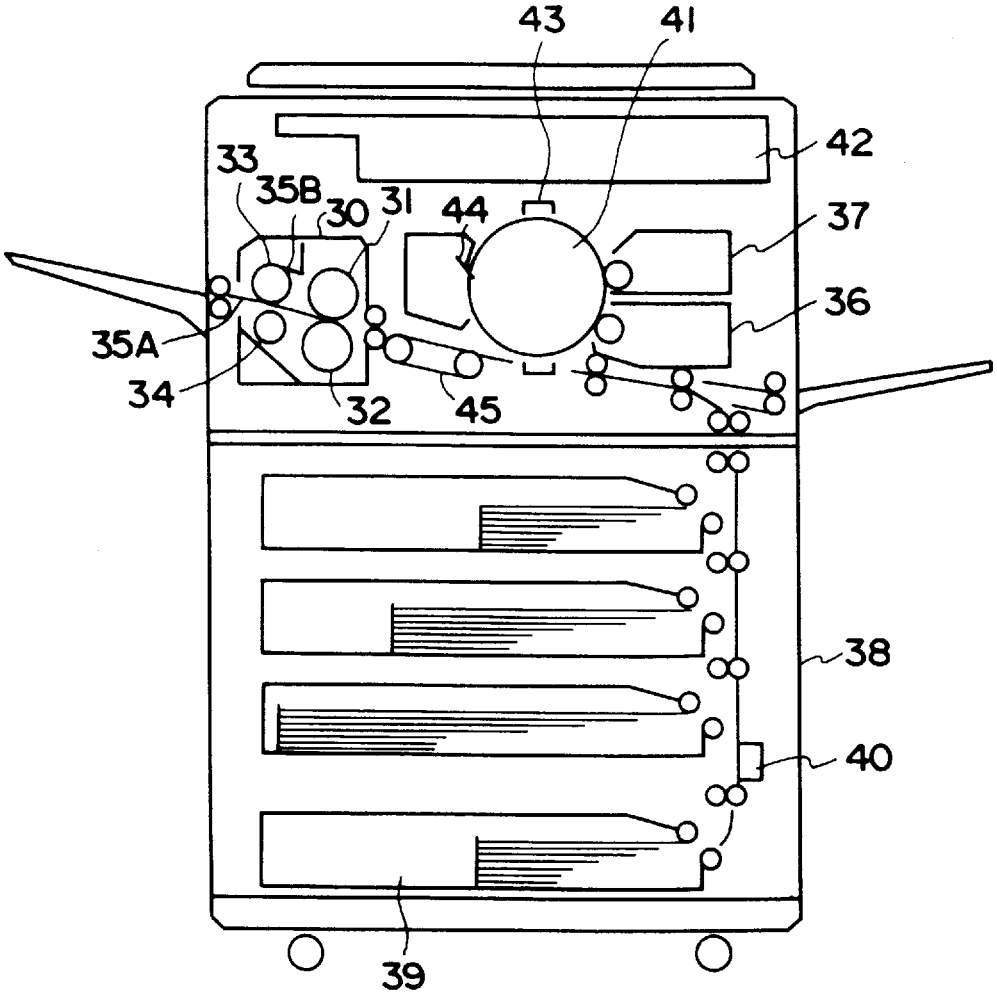
FIG. 3 is a schematic drawing showing one embodiment of the apparatus for reusing an image recording material according to the present invention.
Figure 4:
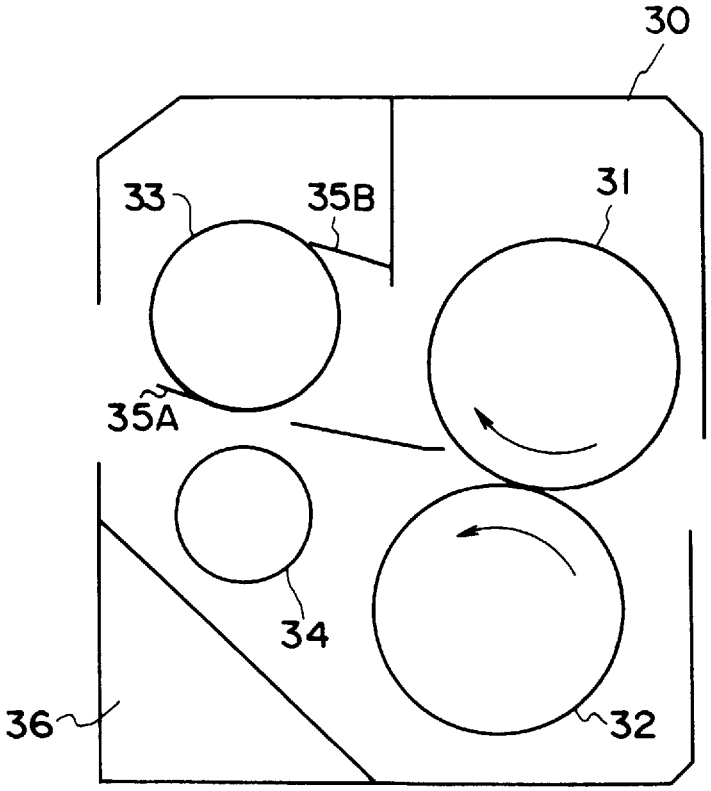
FIG. 4 is an illustrative drawing showing an operating state of the fixation unit in the apparatus of FIG. 3.
Figure 5:
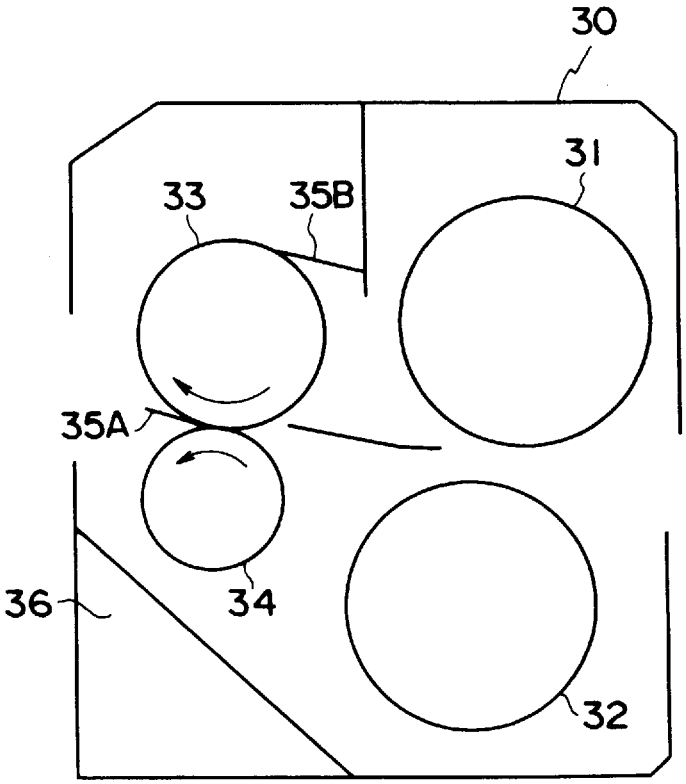
FIG. 5 is an illustration showing another operating state of the fixation unit in the apparatus of FIG. 3.

FIG. 3 shows an example of the reusing apparatus incorporated into a copying machine and FIGS. 4 and 5 depict the operating conditions in a fixing unit 30. In the apparatus shown in FIG. 3, the following fixing unit is mounted in place of a conventional fixing unit as provided in a conventional copying machine. The fixing unit 30 has a heat roller 31 and a pressure roller 32, the distance between their peripheral surfaces the rollers 31 and 32 being adjustable. In addition to these rollers, the unit 30 comprises a heating and stripping roller 33 used for both heating and stripping, the surface of which has been aluminum-anodized, and a pressure roller 34, the distance between their peripheral surfaces of the rollers 33 and 34 being adjustable. Further, a strip finger 35A is disposed on the lower end of the heating and stripping roller 33 such that the tip of the finger 35A is in contact with the peripheral surface of the stripping heat roller 33. A metal blade 35B is disposed on the upper side of the heating stripping roller 33 such that the tip of the blade 35B is slidably in contact with the roller 33.

The copying machine comprises a developing unit 37 for reuse in addition to a conventional developing unit 36. The developing unit 37 for reuse contains a colorless toner consisting essentially of components obtained by excluding the coloring agent from the developing agent contained in the conventional developer 36. A mode switching means (not shown) is also provided so as to adjust distances between the heat roller 31 and the pressure roller 32 and between the heating and stripping roller 33 and the pressure roller 34 as shown in FIGS. 4 and 5, respectively. In a supplier 38, reusing trays 39 containing recording paper for reuse are provided. In the transporting path of the recording paper for reuse from the trays 39, an image sensor 40 is provided and an exposure pattern is set according to the information of the image sensor 40.

In FIG. 3, other main portions are substantially the same as those in conventional copying machines and there are present a photoreceptor 41, a control unit 42 for optical system, an exposing device 43, a cleaner 44 and a transporting belt 45.

The copying procedures using recording paper in this copying machine and the reusing procedures of recording paper on which images have been formed will be described hereinafter.

In conventional copying processes, the surface of the photoreceptor 41 is uniformly charged with electrostatic charge, and the surface is exposed in accordance with image information from the exposing device 43 through the optical control system 42 to form an electrostatic latent image corresponding to the exposure on the surface. Then, the toner is supplied from the developing unit 36 onto the electrostatic latent image on the surface of the photoreceptor 41 to visualize and develop the electrostatic latent image. The thus obtained toner image is transferred onto paper and the paper is transported by the transporting belt 45 into the fixing unit 30. In the fixing unit 30, the heat roller 31 and the pressure roller 32 are provided to be pressed each other as shown in FIG. 4, and the paper onto which the toner image has been attached is fixed by heat and pressure. The heating and stripping roller 33, and the pressure roller 34 are spaced from each other and the thus fixed image recording paper is discharged out of the fixing unit 30.

The reusing procedures of recording paper on which an image has been formed will be now described.

Image recording paper is contained in the reusing tray 39. The reusing developing unit 37 is actuated by the operation of the switching mode and the rollers in the fixing unit 30 are set as shown in FIG. 5 to be in the recording paper reusing mode. In the transporting path, the image of the image recording paper from the reusing tray 39, is read out by the image sensor 40 and the image information is inputted into the optical control system 42 to set a region to be erased on the image recording paper. The image recording paper is exposed by the exposing device 43 in the pattern corresponding to the region to be eased to form an electrostatic latent image corresponding to the region to be erased.

This electrostatic latent image is developed with a colorless toner supplied from the reusing developing unit 37. Accordingly, the colorless toner is attached onto the surface of the image in the image recording paper. In this state, the image recording paper is transported to the fixing unit 30. In the fixing unit 30, the heat roller 31 and the pressure roller 32 are spaced from each other and the image recording paper is passed through the gap between these rollers 31, 32 to reach between the heating and stripping roller 33 and the pressure roller 34.

The heating and stripping roller 33 is heated and the image recording paper is heated and pressed between the heating and stripping roller 33 and the pressure roller 34. The colorless toner and colored toners on the image portion are molten and attached onto the heating and stripping roller 33 and then peeled off by the strip finger 35A from the recording paper. In this manner, the image recording paper is reused. The colorless toner and colored toner on the image portion which are attached onto the heating and stripping roller 33 are removed from the heating and stripping roller 33 by the metal blade 35B and recovered in the collecting box 36.

Thus, in this reusing apparatus, conventional copying process and reusing process can be switched to each other by a switching means merely by modifying a fixing unit and the like in conventional copying machines.

The above described embodiment is concerned with the reusing apparatus for monochromatic copying processes. The reusing apparatus according to the present invention may be provided with a fixing device as mentioned above and a reusing developing unit for reuse even in multicolor copying processes.

In the method for reusing image recording materials according to the present invention, image portions can be efficiently stripped from the image recording materials without causing problems of operating environments or a great deal of energy consumption as in cases where organic solvents or aqueous solutions are used, since the surface of the image recording materials has releasability and the image recording materials can be reused by use of a heat fusible material.

According to the apparatus for reusing image recording materials of the present invention, if the apparatus comprises a means for adding or attaching a heat fusible material, a means for stripping an image forming material and the heat fusible material, and a modified fixing unit of conventional copying machines, the apparatus can be used as both a conventional copying device and the reusing device, and therefore any individual can reuse image recording materials in offices and homes. Since no additional device is -introduced for reusing image recording materials, lower cost and reduction of installation space can be achieved. The present invention may be applicable to both monochromatic and color copying. Further, partial erasing is also possible. A high repeatability can also be attained. Since paper can be repeatedly reused, the present invention is advantageous in view of the global environment and in view of the reduction in amounts of utilization of paper resources and amounts of $CO_2$ discharged into the atmosphere (prevention of global warming).

EXAMPLES

The present invention will be further illustrated by the following examples which do not limit the invention in any way. In the examples and comparative examples, "parts"are by weight.

Example 1

A coating solution was prepared by mixing under stirring 500 parts of ORGATICS SIC-434 (manufactured by MATSUMOTO KOSHO) containing an isocyanatosilane compound and 500 parts of ethyl acetate. An A-4 size of Xerox J paper (Fuji Xerox Co., Ltd.) was impregnated with the solution, air-dried for 5 minutes, and heat-treated in an oven at 120° C. for 10 seconds to prepare recording paper having releasability with regard to a toner.

On the recording paper, color images including letters and solid images were fixed by a color copying machine (A color 635, manufactured by Fuji Xerox Co., Ltd.) and subjected to the following test to estimate the toner fixability. Good fixability was observed.

Toner fixability: A commercially available 18 mm (in width) cellophane adhesive tape (manufactured by Nichiban Co., Ltd.) was stickedat a linear pressure of 300 g/cm onto the fixed solid image portion with an optical density of about 1.8 as measured by X-Rite 938 densitometer (manufactured by X-Rite) and peeled off at a speed of 10 mm/sec. A ratio of the image density after peeling to the image density before peeling (hereinafter referred to as OD ratio, i.e., image density after peeling off/image density before peeling off) was used as an index for estimation. An electrophotographic recording paper should practically have the OD ratio of 0.8 or higher while the thus prepared recording paper had the OD ratio of 0.97.

The toner fixed in the color images was composed of a polyester type resin as a main component. The same polyester type resin, Vylon 300 (manufactured by Toyobo Co., Ltd.), as a heat fusible material was drawn under heat and pressure to form a sheet film of about 100 $\mu$m in thickness. This was placed onto the image of the above paper and inserted into an apparatus as shown in FIG. 1. When the paper was transported into the apparatus by the transporting rollers and the transporting belt, the image was heated from above by the heater preheated at 100° C. so that the toner and the heat fusible material were fused. The recording paper was brought into contact with the stripping roller under pressure whose surface had been anodized to form an anodized aluminum layer (alumite) to separate the heat fusible material containing the toner from the recording paper by the strip finger (FIG. 2). The toner was thoroughly removed from the recording paper. The amount of remaining toner after stripping the toner was estimated in terms of OD ratio as in the above toner fixability test. The image density, in terms of OD ratio, of the remaining toner which is not noticeable is desirably 0.08 or lower. The above recording paper had an OD ratio of 0.045 on average.

Example 2

The heat fusible material used in Example 1, was kneaded with TOSPEARL 130 (average particle diameter 3 $\mu$m: manufactured by Toshiba Silicone) upon drawing under heat and pressure to form a sheet film of about 100 $\mu$m in thickness. The reusing property of the image recording paper was estimated by the same manner as that in Example 1 and the image density, in terms of OD ratio, of the remaining toner was 0.03 on average, which was superior to that of Example 1.

Comparative Example 1

The heat fusible material used in Example 1 was replaced by a heat resistant material, polyimide resin film (100$\mu$m in thickness) and the reuse of the image recording paper was estimated by the same manner as that in Example 1. The image density, in terms of OD ratio, of the remaining toner was 0.25 to 0.35, that is, the letters and images were clearly recognized.

Example 3

As in Example 1, color images including letters and solid images were fixed with a color copying machine (A color 635, manufactured by Fuji Xerox Co., Ltd) on the recording paper. Then, the fixing device was removed from this color copying machine and the heat roller having a surface layer of silicone rubber was substituted by a heat roller whose surface had only been subjected to anodizing oxidation to form an anodized aluminum layer and a metal blade for stripping the stripped materials attached to the heat roller therefrom. This heat roller was used as both a stripping member and a heat source in the color copying machine.

Then, a toner was used as a heat fusible material. Information was inputted to the color copying machine so that the toner was uniformly added to the whole surface of the image portion on the recording paper on which color images had been fixed to form a solid image. The recording paper was set and the color copying machine was operated. The output recording paper was free of toner and showed that the recording paper was completely regnerated. The image density of remaining toners varied slightly depending upon the color of toner and the OD ratios were, on average, 0.05 for black, 0.03 for yellow, 0.04 for magenta and 0.04 for cyan, all showing sufficient releasability.

Comparative Example 2

The procedures of Example 3 were repeated except that no heat fusible material was used or no toner was added. The image density of remaining toner of each color (OD ratio) was, on average, 0.40 for black, 0.23 for yellow, 0.30 for magenta and 0.31 for cyan. Letters and images were clearly recognized.

EXAMPLE 4

No pigment was introduced into the toner used in the color copying machine (A color 635) to prepare a colorless toner. The black toner used in Example 3 was replaced by the colorless toner in the developer of the color copying machine and the reusing property was estimated by the same manner as that in Example 3. The image density (OD ratio) of remaining toners was 0.02 on average indicating good releasability.

Example 5

On the image recording paper prepared in Example 1, letter images were fixed with a black toner of the color copying machine A color 635. To erase a part of the letter images, information was inputted to the color copying machine so that a solid image was added over the image portion to be erased of the recording paper. Using the colorless toner as in Example 4, the reusing property of the image recording paper was similarly estimated. As a result, the original image was scarcely recognized in the erased portion. In the unerased portions, the density of the letters was slightly lowered but the letters were still clearly noticeable with a sufficient density. Thus, it was found that partial erasion could be done.

Example 6

A copying machine Able1301α (manufactured by Fuji Xerox Co., Ltd.) was modified to make a modified copying machine as shown in FIG. 3. Using this modified copying machine, the reusing characteristics of recording paper were estimated. Images including black letters and solid images were fixed on the recording paper prepared in Example 1 by the modified copying machine. The recording paper was set in the toner removing reuse tray shown in FIG. 3 and the copying machine was operated in a monochromatic color copy mode. The recording paper was entirely regenerated. The image density (OD ratio) of the remaining toner was 0.015 on average, indicating good releasability. A single sheet of the recording paper was repeatedly reused ten times by the copying machine, and it was found that the sheet was sufficiently reusable. The letter images were continuously reused on 1,000 sheets of the recording paper, and initial stripping performance was maintained.

What is claimed is:

1. A method for reusing an image recording material, on the surface of which a releasing property is imparted, comprising the steps of adding or attaching a heat fusible material onto an image recording material which has an image made of an image forming material containing a heat fusible ingredient on the surface of the image recording material; contacting a stripping member under pressure with the heat fusible material while heating the heat fusible material together with the image forming material to fuse; and peeling the image recording material from the stripping member to transfer the image forming material together with the heat fusible material to the stripping member, thereby reusing the image recording material.

2. The method for reusing an image recording material according to claim 1, wherein said image forming material and heat fusible material each contain the same heat fusible ingredient.

3. The method for reusing an image recording material according to claim 2, wherein said heat fusible ingredient is at least one resin selected from the group consisting of polyester and silicone resins.

4. The method for reusing an image recording material according to claim 1, wherein said heat fusible material is a powdery heat fusible material.

5. The method for reusing an image recording material according to claim 4, wherein said powdery heat fusible material is a toner.

6. The method for reusing an image recording material according to claim 5, wherein said powdery heat fusible material is a colorless toner.

7. The method for reusing an image recording material according to claim 5, wherein said heat fusible material contains fine particles.

8. The method for reusing an image recording material according to claim 7, wherein said fine particles are at least one of fine particles selected from the group consisting of titanium oxide, aluminum oxide, zirconium oxide, barium titanate, silica, silicone resins, acryl resins, styrene-acryl resins, melamine resins, benzoguanamine resins, and melamine-benzoguanamine resins.

9. The method for reusing an image recording material according to claim 1, wherein said releasing property is imparted by at least one silicone compound selected from the group consisting of fluorine-containing silicone compounds, silane compounds, isocyanatosilane compounds, and modified silicone oils.

10. The method for reusing an image recording material according to claim 9, wherein said silicone compound contains at least one fine particle selected from the group consisting of talc, kaoline, calcium carbonate, titanium oxide, aluminum oxide, aluminum sulfate, zirconium oxide, barium titanate, silica, silicone resins, acryl resins, styrene resins, styrene-acryl resins, melamine resins, benzoguanamine resins, and melamine-benzoguanamine resins.

* * * * *